US008671861B2

(12) United States Patent
Konig et al.

(10) Patent No.: US 8,671,861 B2
(45) Date of Patent: Mar. 18, 2014

(54) PLACEMENT DEVICE FOR PLACING DECORATIVE ELEMENTS ON A TEXTILE OR NON-TEXTILE SHEET MATERIAL

(75) Inventors: Michael Konig, Constance (DE); Frank Prufer, Hilzingen (DE)

(73) Assignee: BERNINA International AG, Steckborn (CH)

( * ) Notice: Subject to any disclaimer, the term of this patent is extended or adjusted under 35 U.S.C. 154(b) by 563 days.

(21) Appl. No.: 12/813,881

(22) Filed: Jun. 11, 2010

(65) Prior Publication Data

US 2010/0313806 A1 Dec. 16, 2010

(30) Foreign Application Priority Data

Jun. 15, 2009 (CH) ..... 0928/09

(51) Int. Cl.
*D05B 1/00* (2006.01)

(52) U.S. Cl.
USPC ..... 112/475.07

(58) Field of Classification Search
USPC ..... 112/475.01, 11, 104, 152, 153, 113, 112/115, 470.14, 475.07, 475.08
See application file for complete search history.

(56) References Cited

U.S. PATENT DOCUMENTS

| | | | | | |
|---|---|---|---|---|---|
| 2,815,899 | A | * | 12/1957 | Swanson | 383/92 |
| 3,498,244 | A | * | 3/1970 | Blanchette | 493/226 |
| 3,580,474 | A | * | 5/1971 | Provost et al. | 229/125.125 |
| 4,157,692 | A | * | 6/1979 | Brocklehurst et al. | 112/475.06 |
| 4,590,872 | A | * | 5/1986 | Bray | 112/470.07 |
| 4,623,411 | A | * | 11/1986 | Pollak et al. | 156/93 |
| 4,986,524 | A | * | 1/1991 | Meintzer et al. | 271/100 |
| 5,479,757 | A | * | 1/1996 | Ogawa | 53/135.1 |
| 6,022,014 | A | * | 2/2000 | Rathert et al. | 271/11 |
| 8,146,520 | B2 | * | 4/2012 | Polstra | 112/11 |

FOREIGN PATENT DOCUMENTS

| | | |
|---|---|---|
| DE | 3737041 | 5/1989 |
| JP | 02013495 | 1/1990 |
| JP | 2002113271 | 4/2002 |
| WO | 2006134634 | 12/2006 |

* cited by examiner

*Primary Examiner* — Tejash Patel
(74) *Attorney, Agent, or Firm* — Volpe and Koenig, P.C.

(57) ABSTRACT

A placement device (3) for placing decorative elements (5) on a textile or non-textile sheet material is connected to a sewing machine. The decorative elements (5) are stored in an ordered way in magazines (7) and are fed in a controlled way by the control of the sewing machine to the appropriate set positions on the sheet material (39) and are connected to this material.

9 Claims, 2 Drawing Sheets

PLACEMENT DEVICE FOR PLACING DECORATIVE ELEMENTS ON A TEXTILE OR NON-TEXTILE SHEET MATERIAL

CROSS-REFERENCE TO RELATED APPLICATIONS

This application claims the benefit of Swiss Patent Application No. 00928/09, filed Jun. 15, 2009, which is incorporated herein by reference as if fully set forth.

BACKGROUND

The invention is directed to a placement device and a method for placing decorative elements on a textile or non-textile sheet material.

Articles of clothing, as well as other textile and non-textile sheet materials can be embellished by applying decorative elements, such as sequins, rhinestones, rivets, and the like. Such applications are realized conventionally by industrial machines constructed especially for each task. Rhinestones are normally covered on the back side with a hot-melt layer. For the industrial production of motifs or arrangements of rhinestones on articles of clothing, the individual rhinestones are typically separated from bulk supplies, arranged, and placed onto the article of clothing. The fixing or connecting process to the article of clothing is performed immediately after the setting process, wherein the hot-melt adhesive is activated, e.g., by supplying energy by an ultrasonic sonotrode. It is also known to apply industrially prefabricated motifs in mirror-inverted representation on transfer films. Here, the rhinestones are placed on this transfer film with the visible side directed toward the self-adhesive transfer film and then covered with an additional protective film. Such arrangements of rhinestones produced as unfinished products can then be purchased and bonded on surfaces in the desired way or connected rigidly to these surfaces by means of conventional flat irons or presses. For guaranteeing high quality, the most uniform possible supply of a certain quantity of energy to each of the rhinestones is advantageous.

Alternatively, rhinestones could also be applied at home, e.g., individually by tweezers onto a transfer film. Or the rhinestones are held and placed directly onto the article of clothing. Then, through a piston-like applicator with an electrical heating device or an ultrasonic sonotrode, the required energy is fed for heating the adhesive for connecting the rhinestone to the article of clothing. Such applicators can be adapted, e.g., by adapters to different sizes and shapes of the rhinestones.

Conventionally, the efficient application of individually shaped rhinestone arrangements on articles of clothing is possible only by expensive machines designed for commercial use. These machines are constructed only for the application of rhinestones and are not suitable for other decorative elements.

SUMMARY

Therefore, the objective of the present invention is to create a device and a method that allow, also in the home, a simple and efficient production of individual rhinestone applications. An additional task of the invention lies in constructing the device and the method so that, as an alternative or addition to rhinestones, other decorative elements, such as, e.g., rivets, sequins, stones, films, stamps, etc., can also be applied onto a sheet material.

These tasks are achieved by a placement device that can be connected to a sewing machine and by a placement method for textile and non-textile sheet materials according to the invention.

The invention uses the knowledge that the placement of decorative elements at certain positions of an sheet material has similarities with the construction of sewing stitches by a sewing machine during sewing or embroidery, and that functions of a sewing machine—be it now functions of the electronic sewing machine control or mechanical movement sequences—can be used for the arrangement of decorative elements at certain positions of an sheet material. The placement device according to the invention is connected to a household sewing machine and uses functions of this sewing machine for applying or setting decorative elements at positions that are or can be specified in advance on a textile or non-textile sheet material. For an advantageous construction of the invention, instead of a conventional presser foot, the placement device can be attached to the presser foot bar of the sewing machine. The placement device comprises a placement head that can be controlled by the control of the sewing machine for the sequential application of decorative elements at positions that can be or are specified in advance on the sheet material. For this purpose, the sheet material can be moved relative to the placement device selectively, e.g., by hand or by an embroidery hoop or by a different positioning or transport device, such as, e.g., the feed dog of the sewing machine. Alternatively, the placement device or the sewing machine with the placement device could also be moved equivalently relative to the sheet material.

The individual set positions can be stored, e.g., analogous to the embroidery positions when embroidering with an embroidery program and can be called up by the sewing machine control.

According to the construction of the invention, the term "control" can comprise only the sewing machine control itself or also one or more additional control devices interacting with the sewing machine control, for example, control electronics of the placement device or an embroidery hoop or a computer with a higher rank than the sewing machine. The decorative elements are ready-to-use and—in contrast to bulk goods—are stored in a defined way in a storage medium or magazine. Such a magazine could have a different construction. Through the use of a corresponding feeder device, the magazine or parts of this can be moved in a controlled way by the control, such that decorative elements stored in the magazine can be relocated by the placement head from the magazine to the desired positions on the sheet material. Alternatively, the feeder device could also move the decorative elements directly, in order to bring these into a suitable transfer position. The application of the decorative elements can be performed selectively by hand or individually (e.g., triggered by a foot switch) or controlled by a program or automatically (analogous to an embroidery program).

The placement head can be constructed and act differently consistent with the magazines being used and each feeding device. It could comprise, for example, a shuttle or a collet chuck with which the decorative element is moved in a suitable way to the corresponding support position and then released again at the set position on the sheet material. The placement head can also comprise an element for pressing decorative elements out from a hold of the magazine and/or for pressing decorative elements onto the sheet material, wherein the contact force advantageously can be set or adjusted or controlled. In particular, the placement head could be arranged and constructed so that it can be activated by movements or by the application of force by the needle bar.

Alternatively or additionally, other movements of the sewing machine, such as, e.g., those of the sewing foot presser bar or the feed dog (in or perpendicular to the sewing direction) or the application of forces from additional drives (e.g., step motors, magnets, pneumatic suction devices) could also be used to move the placement head so that it takes decorative elements from the magazine and arranges them in the desired way on the sheet material.

For an advantageous construction of the invention, the magazine is constructed like a kind of cartridge or a parts dispenser. This is lowered at each of the set positions by the movement of the needle bar in the direction of the sheet material. Shortly before reaching the lowermost position, e.g., an activation lever constructed on the magazine contacts a step of the placement device or on the sheet material. For the further lowering of the magazine, a slide or a flap is opened on the magazine, so that an individual decorative element falls from the magazine directly on the sheet material at the provided position. If the placement device is constructed accordingly, the decorative element can also be pressed onto a transfer film. Therefore, a better fixing on the sheet material is possible. Due to the small distance to the sheet material and optionally, e.g., a funnel-like guide constructed on the placement device, the decorative element comes to lie exactly on the desired position or set position on the sheet material. Alternatively, the decorative element could also be transferred in an analogous way to a moving arm or lever or placement device and fed indirectly from this to the provided position.

Advantageously, the magazines have supporting positions adapted to the geometry of the corresponding decorative elements. These supporting positions can be arranged or lined up relative to each other, e.g., at specified constant or standardized distances. An example here is a transport tape or carrier tape with tubs in an equidistant arrangement as supporting positions. Feeding devices for such magazines could be constructed very easily, because the carrier tape must be advanced by only a given distance between two adjacent supporting positions. For this purpose, for example, the sewing movement (up-and-down movement) or the zigzag movement of the needle bar can be used, wherein, e.g., one or more pins connected to the needle bar engage in a regular perforation arrangement along the carrier tape. For alternative embodiments of the placement device, differently constructed magazines, such as, e.g., revolvers or rotary plates, and/or other drives, such as, e.g., step motors or pneumatic parts operating with an overpressure and/or negative pressure can be used for moving magazines and/or parts of magazines and/or decorative elements supported in magazines. There is also the ability for the magazines to have a refillable construction, such that these can be loaded individually with a desired combination of identical or different decorative elements. For placement, the decorative elements are placed in the specified sequence of support positions at the provided set positions on the sheet material.

As an alternative to supporting positions lined up in one dimension, magazines could also comprise supporting positions arranged in a defined way like an array in several rows or in a different way. If necessary, additional parameters could be set for individual supporting positions of the magazines or for groups of supporting positions, wherein these parameters can be taken into account by the control for setting the decorative elements. Such parameters can comprise, for example, information on the type, size, color, desired connection technique, etc., of the decorative elements supported at these support positions and/or information on the support positions themselves, e.g., information on their shape, size, arrangement, orientation, and the like. Such parameters can be reported to the control, e.g., by an input terminal and stored in a storage medium. Alternatively, sensors could also be provided for detecting individual, multiple, or all of the parameters to be detected. In particular, for this purpose, an image sensor or a camera could be used in connection with an image-processing device. As an alternative to the direct detection of such parameters, these could also be detected in advance during production or during the filling of the magazines and stored in a suitable storage medium on each magazine. Such storage media are, e.g., stitch codes or RFID tags. They could be detected by a corresponding reading device of the placement device and processed by the control.

The consideration of such information detected and stored in advance makes the placement process significantly more flexible: with reference to stored parameter values, e.g., a targeted access to supporting positions of difference decorative elements is possible. In this case, it is not necessary to access adjacent supporting positions in a specified sequence.

The orientation of a decorative element or its positional angle relative to the sheet material can be, according to the construction of the invention, e.g., random or defined by a forced or specified position of the decorative element at or in the supporting positions of the magazine. Thus, the supporting positions could comprise, e.g., springs or other elastically flexible parts, such as coverings that are made from silicon rubber and that hold the decorative elements in a defined position. As an alternative or addition, the placement head could comprise a rotating device that could be used for orienting the decorative element. In connection with a camera, the control can automatically recognize the position and situation of decorative elements at the supporting positions of the magazines and can place the decorative elements in the specified orientation on the sheet material. The invention comprises magazines and feeding devices in different constructions. Advantageously, for moving the feeding device and/or the placement head, drives of the sewing machine are used (e.g., drive for the needle bar movement, the zigzag movement of the needle bar, feed dog drive, lifting movement of the sewing presser foot bar). Alternatively or additionally, motors of an embroidery module (x-y table) connected to the sewing machine or other external actuators that can be controlled by the sewing machine, such as, e.g., magnets or step motors could also be used for this purpose. Suitable magazines are, e.g., carrier tapes, belts, cassettes, cartridges, parts dispensers, capsules connected flexibly or rigidly to each other, rotary plates, and the like.

With the placement device according to the invention, decorative elements can be placed selectively on textile or non-textile sheet materials. In particular, decorative elements could also be applied to transfer films and later connected to the desired surfaces.

In addition to setting or arranging the decorative elements, the placement device can also comprise a joining or connecting device for the temporary or permanent connection of the decorative elements to the sheet materials. This connecting device can be constructed for performing one or more different joining techniques. Examples here are hot melt adhesive, gluing, welding, sewing, rivets. The individual decorative elements are advantageously connected to the sheet material during or immediately after the setting, so that they maintain the desired positioning. For this purpose, the connecting device could be formed completely or partially on the placement head.

For activating a hot-melt adhesive on the decorative element, the required thermal energy can be supplied locally to this element, e.g., in a non-contact method by a laser or through contact with an applied ultrasonic sonotrode or an electrical heating device.

For bonding decorative elements by other adhesives, the placement device can advantageously comprise a glue dispenser on the placement head. Before placing and pressing a decorative element on the sheet material, a small dose of adhesive is deposited either on the bottom side of the decorative element or on the provided placement site of the sheet material. Alternatively, the bottom sides of the decorative elements could also be equipped with micro-encapsulated adhesive. During placement, these decorative elements are pressed with sufficient force onto the sheet material. In this way, the micro-capsules burst. The released adhesive connects the decorative elements to the sheet material.

Certain decorative elements, such as, e.g., rivets or deformable foil or stamp parts, can be attached on the sheet material by shaping techniques, such as, riveting or crimping. Perforated decorative elements, such as, e.g., sequins or buttons, could also be sewn tightly on the sheet material. This obviously also applies for textile or other parts that can be pierced by a sewing needle or for fitted parts or parts to be sewn on in some other way. Because the sewing machine is already constructed for this connection technique, it is not necessary to also construct a corresponding connecting device on the placement device. If the placement device is to be used in connection with a sewing process for attaching the decorative elements, then they must be constructed and attached to the sewing machine, so that the sewing process is not hindered. Decorative elements can be sewn tight, e.g., immediately after being set. Alternatively, the decorative elements could also be placed in a first processing step temporarily, e.g., by means of a replaceable double-sided adhesive non-woven material on the sheet material and then sewn tight in a second processing step. Such non-woven materials can also contain adhesives for a permanent connection that can be activated, e.g., by pressure.

The placement device or parts of this can be connected as described to the sewing machine in the region of the sewing machine head above the sheet material to be processed or alternatively in the region of the bottom arm of the sewing machine underneath the sheet material to be processed. Combinations with interacting, active and/or passive parts on both sides of the sheet material to be processed are also possible. Thus, for example, the placement head could be attached to the sewing foot pressure bar above the sheet material and activated by the movement of the needle bar. The stitch plate of the sewing machine can be replaced, e.g., by a passive work plate that comprises contact zones corresponding to the placement head for pressing the decorative elements. In addition, in the region of the bottom arm or the work plate, templates needed, e.g., for crimping, stamping, or riveting for the shaping or some other processing of the decorative elements could be constructed. Instead of or in addition to such passive elements or connection means, active elements for connecting the decorative elements to the sheet material could also be provided. Examples here are heating devices, ultrasonic sonotrodes, or UV light sources for activating or hardening the adhesive. For alternative embodiments of the placement device, decorative elements could also be placed on the sheet material from the bottom side or on both sides.

BRIEF DESCRIPTION OF THE DRAWINGS

Two example embodiments of the invention are described in detail with reference to the drawing figures. Shown here are

DETAILED DESCRIPTION OF THE PREFERRED EMBODIMENTS

Figure 1:
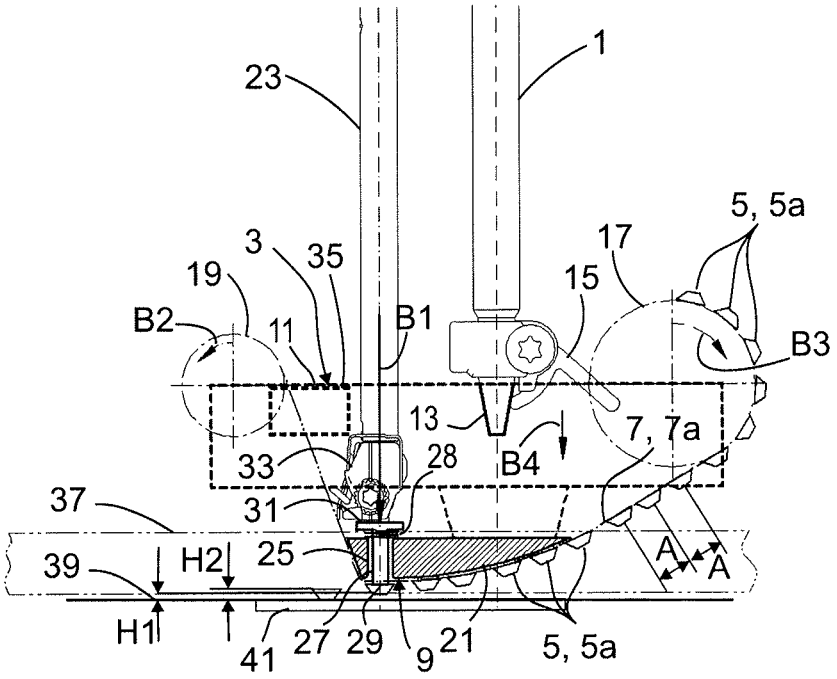
FIG. 1 is a schematic representation of a placement device attached to the sewing foot presser bar in a first embodiment.

In a schematic representation, FIG. 1 shows a first embodiment of a placement device 3 that is used for decorative elements 5 and that is attached analogously to a presser foot to a material pressure foot or presser foot 1 of a sewing machine. In the illustrated example, these decorative elements 5 are rhinestones 5*a* that are held detachably at regular or identical intervals A on a tape-shaped, rolled-up carrier tape 7*a*. The carrier tape 7*a* is a special construction of a magazine 7 that is constructed for the ordered storage of decorative elements 5 and for feeding these decorative elements 5 to a part of the placement device 3 designated, in general, as placement head 9. The placement device 3 comprises a base part 11 with a sewing presser foot shaft 13 for holding the normally conical lower end of the sewing pressure foot bar 1. The base part 11 is connected rigidly to the sewing presser foot bar 1 analogous to a sewing presser foot by a retaining clip 15. On the base part 11, a replaceable supply roll 17 and a take-up roll 19 are each supported so that they can rotate. The carrier tape 7*a* with the rhinestones 5*a* is rolled up on the supply roll 17. The front end of the carrier tape 7*a* is connected to the take-up roll 19 so that the carrier tape 7*a* can be unwound from the supply roll 17 onto the take-up roll 19. Between the supply roll 17 and the take-up roll 19, the carrier tape 7*a* is guided by a convexly curved guide web 21 constructed on the bottom side of the base part 11 under the needle bar 23 of the sewing machine. Advantageously, the carrier tape 7*a* is held slightly in tension between the supply roll 17 and the take-up roll 19, so that it contacts the guide web 21 in a defined way. In the region of the lowest-lying position of the guide web 21, a continuous borehole 25 is defined coaxial to the needle bar axis, wherein a pin or press plunger 27 is supported so that it can be moved in this borehole in the axial direction. The press plunger 27 is loaded by a restoring spring 28 and held on the guide web 21 or, in general, on the base part 11, such that its lower-lying contact face 29 does not project beyond the borehole 25 without the action of additional forces. An advantageously impact-damping contact plate 31 is formed on the upper end of the press plunger 27.

For performing a lowering movement of the needle bar 23 in the direction of arrow B1, as it is otherwise constructed for sewing or embroidering, a feeding device 35 (shown only symbolically by a rectangle for the sake of better clarity) transports the carrier tape 7*a* forward by an advance length that corresponds to the distance A between adjacent bearing positions of the carrier tape 7*a*. The downward movement of the needle bar 23 is used for driving the feeding device 35. For this purpose, e.g., a catch (not shown) can extend on the needle bar 23, wherein this catch comes in contact with a corresponding activation lever (not shown) on the base part 11 for the downward movement of the needle bar 23. The activation lever is moved at least on one section of the downward movement of the needle bar 23 by the catch and thus drives the feeding device 35. The feeding device 35 can comprise, e.g., a latch mechanism (not shown) that moves the carrier tape 7*a* forward exactly by the desired advance length in the provided feeding direction. Alternatively or additionally, the movement of the needle bar 23 could also be used to rotate the take-up roll 19 and/or the supply roll 17 in a corresponding way or to tension a spring drive (not shown) that keeps the carrier tape 7*a* slightly tensioned between the supply roll 17 and the take-up roll 19. In this position, the decorative element 5 located under the press plunger 27 has a small distance H1 to the sheet material 39 of, for example, 2 to 4 mm. Advantageously, this distance H1 is somewhat larger than twice the maximum height H2 of that of the decorative element 5 to be placed, with the height of this element typically lying, in the case of rhinestones 5*a*, on the order of magnitude of approximately one to two millimeters. In this way it is achieved that the sheet material 3 can still be moved freely in a horizontal placement plane even for decorative elements 5 that have been already placed. Alternatively, the feeding device 35 could also be driven by upward movements or by zigzag movements of the needle bar constructed perpendicular to these upward movements. By advancing the carrier tape 7*a*, the next support position with the next decorative element 5 to be placed comes to lie directly under the press plunger 27. In agreement with the advancement of the carrier tape 7*a*, the take-up roll 19 and the supply roll 17 rotate in rotational directions specified by the arrows B2 and B3.

After the decorative element 5 to be placed has been brought into the correct transfer position under the press plunger 27 through the advancing of the carrier tape 7*a*, for further lowering of the needle bar 23, its lower end or the needle holder 33 arranged there contacts the contact plate 31 shortly before reaching the reversing point. For the further downwards movement, the needle bar 23 presses the press plunger 27 downward against the force of the restoring spring 28. The contact face 29 presses from the back side against the carrier tape 7*a*, and, indeed, exactly at the support position with the decorative element 5 to be placed. In this way, the decorative element 5 is released from the carrier tape 7*a* and falls onto the sheet material 39 that is located at a small distance underneath and that is tensioned in an embroidery hoop 37. In the shown example, the sheet material 39 is a self-adhesive transfer film. The flexible carrier tape 7*a* comprises an adhesive layer or advantageously isolated adhesive spots at the individual bearing positions on the side facing the sheet material 39. The back sides of the rhinestones 5*a* that are opposite the visible sides and that coated with activatable adhesive are attached in a detachable way on the carrier tape 7*a* at their adhesive positions. As an alternative to attaching the rhinestones 5*a* by adhesive, the supporting positions of the carrier tape 7*a* can also comprise, e.g., receptacles made from silicone or a different elastically spring-like material that surround the decorative elements 5 in a non-positive fit and hold them in a defined position on the carrier tape 7*a*. For the back-side pressure of the press plunger 27, the decorative elements 5 are released from the hold and placed on the sheet material 39.

As an alternative to letting the decorative elements 5 fall from a low height, the carrier tape 7*a* could also be pressed downward by the stroke of the press plunger 27 (due to the movement of the needle bar 23 up to its lower reversing point) and/or optionally by the vertical lifting movement of the sewing foot presser bar 1. The lowering movement of the sewing foot presser bar 1 with the base part 11 attached to it is shown in FIG. 1 by the arrow B4. The decorative elements 5 are pressed by the press plunger 27 onto the sheet material 39. If the lowering movement of the spring-mounted sewing foot presser bar 1 is used for pressing the decorative element 5 onto the sheet material 39, then the decorative elements 5 can be pressed onto the sheet material 39 in a simple way with a contact pressure force that is or can be specified. The sheet material 39 is here supported on a work plate 41. As the work plate 41, for simple constructions of the invention, the stitch plate of the sewing machine can be used. In this case, the axes of the needle bar 23 and the press plunger 27 are advantageously arranged slightly offset relative to each other, so that a suitable contact face of the stitch plate without openings or other interfering elements lies directly underneath the press plunger 27. For alternative constructions, the work plate 41 could also comprise passive or active parts that have a certain function for setting and optionally for connecting the decorative elements 5 to the sheet material 39. Such parts are passive anvils that are, e.g., flat or adapted to the shape of the decorative elements 5 and to the corresponding connection technique or active stop elements that are formed, e.g., for heating the connection point between the pressed decorative element 5 and the sheet material 39. Heating can be performed, e.g., by electrical heating elements, laser light, or ultrasound.

When placing on a transfer film, normally no active parts are required on the side of the work plate 41. For a corresponding stroke of the press plunger 27 and the sewing foot presser bar 1, the decorative elements 5 could also be pressed onto the adhesive layer of the transfer film with a specified force. If the decorative elements 5 are likewise attached with adhesive on the carrier tape 7*a*, then the adhesion there should be lower than for the adhesive of the transfer film. For contact with the transfer film, the decorative elements thus remain bonded to the transfer film, if the needle bar 23 and thus also the press plunger 27 moves upward again.

The sewing machine control or a computer with a higher rank than this control controls the embroidery module connected to the sewing machine with the movable embroidery hoop 37 and the sheet material 39 tensioned in this hoop and the placement device 3 analogous to an embroidery program in the way that, instead of sewing stitches, decorative elements 5 are placed on the sheet material 39 and temporarily or finally connected to this. In the case of sheet materials 39 in the form of transfer films, mirror-inverted patterns or arrangements of decorative elements 5 can be created that are then transferred in an additional processing step that is independent of the placement, e.g., through fusing by means of heat as a whole onto an article of clothing or onto a different sheet material 39 and attached to this clothing or material.

Alternatively, decorative elements 5, such as, e.g., rhinestones 5*a*, could be arranged and attached with the placement device 3 according to the invention also directly on the final sheet material 39—for example, on an article of clothing. In this case, the individual rhinestones 5*a* are placed on the sheet material 39 directly with the back side opposite the visible side. The attachment on the sheet material 39 is realized directly after setting each rhinestone 5*a*, wherein, e.g., micro-adhesive capsules on the back side of the rhinestones 5*a* are crushed by the pressure of the press plunger 27. In this way, the adhesive is released and the rhinestones 5*a* are finally bonded with the sheet material 39. Alternatively, adhesives can be activated, e.g., also through the supply of thermal energy or through light, in order to connect the decorative elements 5 to the sheet material 39. In particular, there is also the ability to deposit an adhesive only directly before the application of each decorative element 5 onto this element or onto the corresponding connection point on the sheet material 39. For this purpose, an adhesive cartridge (not shown) could be arranged, e.g., on the placement device 3. Prior to setting the decorative element 5, the control can trigger the dosing of a specified amount of adhesive from the adhesive cartridge onto the desired position, e.g., through a zigzag pivoting motion of the needle bar 23. If necessary, for depositing the adhesive, the sheet materials 39 tensioned in the embroidery hoop 37 can be temporarily shifted into a different position corresponding to the adhesive cartridge and then shifted back again.

The placement device 3 according to the invention can also be constructed for feeding and attaching decorative elements 5 to sheet materials 39 by means of other connection techniques, such as, e.g., sewing, riveting, stamping, crimping, etc. (not shown).

Figure 2:
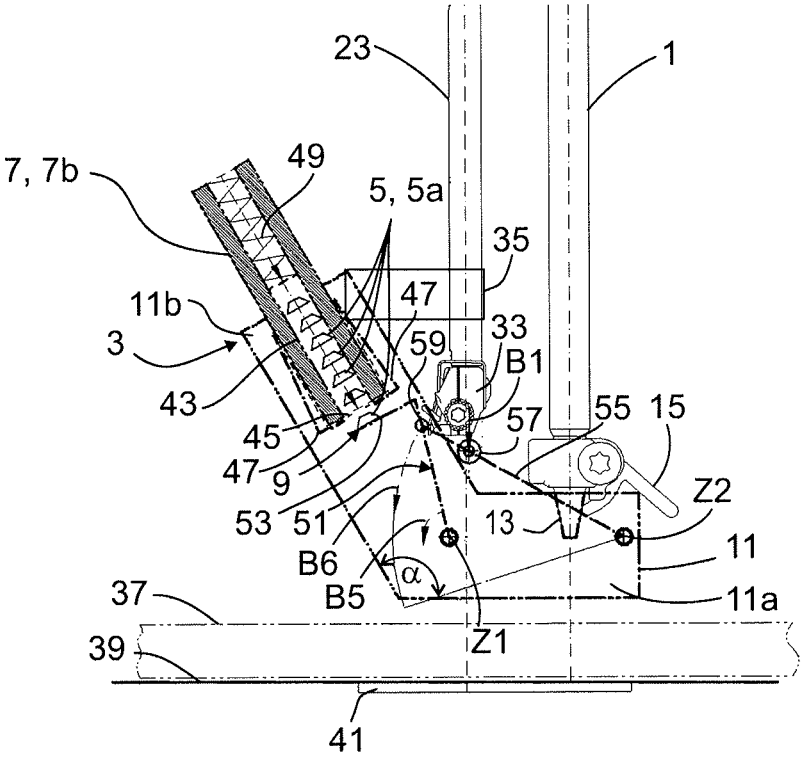
FIG. 2 is a schematic representation of a placement device attached to the sewing foot presser bar in a second embodiment for the removal of a rhinestone from a cartridge-like magazine.

For an additional embodiment of the invention, as shown in FIG. 2, the magazine 7 is constructed as a cartridge 7*b* or frame and is placed detachably on the base part 11 or is connected to this part in some other way. A first leg 11*a* of the base part 11 is attached like in the embodiment according to FIG. 1 to the sewing foot presser bar 1. The cartridge 7*b* is attached to a second leg 11*b* of the base part 11, wherein the two legs 11*a*, 11*b* enclose an obtuse angle $\alpha$ of, e.g., 120°.

Rhinestones 5*a* or other decorative elements 5 are stacked in an ordered way in a holding sleeve 43 of the cartridge 7*b* adapted to the size of these decorative elements 5. The schematic representation in FIG. 2 shows, for the sake of better clarity, only a few of the stacked rhinestones 5*a*. A front-side removal opening 45 of the holding sleeve 43 can be covered by a closing mechanism. Advantageously, this closing mechanism comprises closing flaps 47 that are held by spring force in a closed position. On the back, a magazine spring 49 presses the stacked decorative elements 5 in the receiving sleeve 43 forward, wherein the front-most decorative element 5 is queued at the closed closing flaps 47. Alternatively—for sufficient inclination of the second leg 11*b*—instead of a magazine spring 49, the force of gravity of the decorative element 5 can be used for its advance within the magazine 7. In an arrangement according to FIG. 2, the placement head 9 comprises angled transport lever 51 that can pivot about a first pivot axis Z1 on the base part 11 with a take-up device 53 for transferring the front-most decorative element 5 from the cartridge 7*b* and for transporting this element to the placement position on the sheet material 39. In the representation in FIG. 2, the transport lever 51 is in a loading position, wherein the take-up device 53 is arranged under the removal opening 45 of the cartridge 7*b*. By lowering the needle bar 23, first the closing flaps 47 are opened against the closing spring force. As a drive, here the needle bar movement is used in connection with a feeding device 35 shown schematically only as a rectangle for the sake of simplicity. In this way and through the application of force of the magazine spring 49, the lowermost decorative element 5 is transferred from the cartridge 7*b* to the take-up device 53. It is held tight there predominantly, e.g., pneumatically, by negative pressure or with a spring-mounted clamp (not shown). For further downward movement of the needle bar 23, the feeding device 35 closes the closing flaps 47 again. Through further downward movement of the needle bar 23 up to the lower reversing point, the placement head 9 is activated and here pivots the transport lever 51 with the decorative element 5 held on this lever into a placement position, as shown in FIG. 3.

Figure 3:
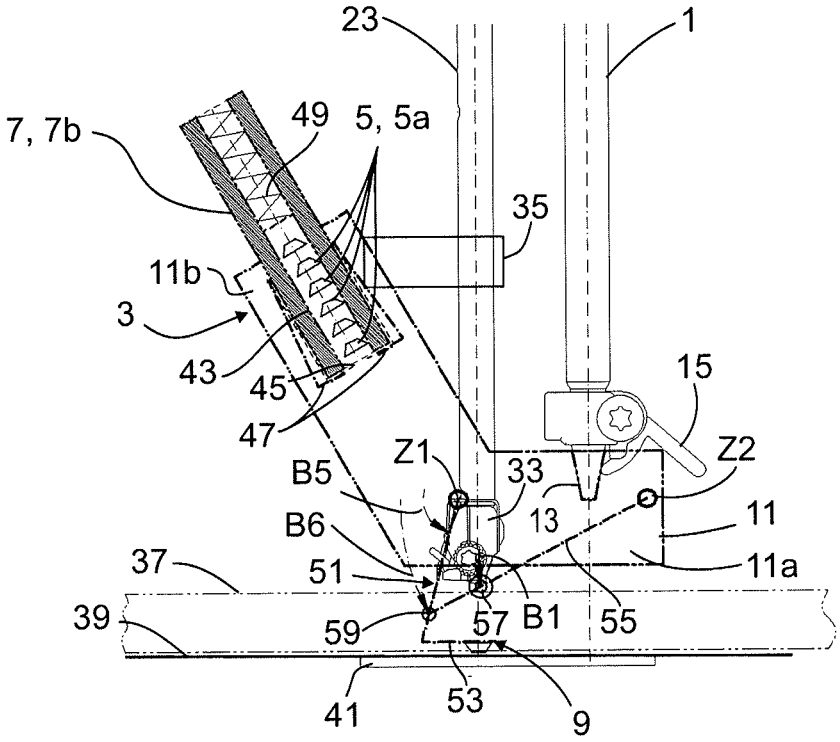
FIG. 3 is a view of the placement device from FIG. 2, wherein the rhinestone is relocated by a lever mechanism into a position suitable for placement on a transfer film.

In FIGS. 2 and 3, the arrows designated with B1 show the lowering movement of the needle bar 23, the arrows designated with B5 show the pivoting movement of the transport lever 51 about the first pivot axis Z1, and the arrows designated with B6 show the pivoting movement of a guide rod 55 that is held on the base part 11 so that it can pivot about a second pivot axis Z2. When the needle bar 23 is lowered and raised, its movement is transferred by a coupling element 57 to the guide rod 55. This realizes a pivoting movement about the second pivot axis Z2. This movement is in turn transmitted by one or more hinges 59 supported on the transport lever 51 so that they can move, such that the placement head 9 rotates from the loading position according to FIG. 2 to the placement position according to FIG. 3 or vice versa. In the placement position, the decorative element 5—similar to the embodiment according to FIG. 1—is placed at the desired position on the sheet material 39 and attached to this material. For the subsequent raising of the needle bar 23, the placement head 9 pivots back into the loading position, in order to receive the next decorative element 5 from the magazine 7.

In addition to these two precisely described embodiments, the invention comprises a plurality of additional placement devices 3 that can be mounted on a sewing machine and that can be used in connection with the control of the sewing machine or a control with a higher rank than or interacting with this control for setting and optionally for fixing decorative elements 5 on sheet materials 39. Advantageously, this sheet material 39 is tensioned in an embroidery hoop 37 or a different tensioning device and can be oriented relative to the placement head 9 in a way controlled by the control. In this way, functions (control functions and/or mechanical functions) of the sewing machine and/or accessory parts of the sewing machine can be used for placing decorative elements 5. In particular, control functions of embroidery programs and movements of parts of the sewing machine can be used, in order to arrange decorative elements 5 or, in general, arbitrary individual parts on the sheet material 39.

LEGEND OF THE REFERENCE SYMBOLS

1 Sewing foot presser bar
3 Placement device
5 Decorative elements
5*a* Rhinestones
7 Magazine
7*a* Carrier tape
7*b* Cartridge
9 Placement head
11 Base part
13 Sewing foot shaft
15 Retaining clip
17 Supply roll
19 Take-up roll
21 Guide web
23 Needle bar
25 Borehole
27 Press plunger
28 Restoring spring
29 Contact face
31 Contact plate
33 Needle holder
35 Feeding device
37 Embroidery hoop
39 Sheet material
41 Work plate
43 Take-up sleeve
45 Removal opening
47 Closing flaps
49 Magazine spring
51 Transport lever
53 Take-up device
55 Guide rod
57 Coupling element
59 Hinge

The invention claimed is:

1. Placement device (3) that can be connected to a sewing machine comprising a placement head (9) that can be influenced by the sewing machine for setting decorative elements (5), which are stored in an ordered way in a magazine (7), at positions that are or can be specified in advance on a textile or non-textile sheet material (39), and wherein the placement head (9) or a part thereof is movable by a drive of the sewing machine or by an external motor or actuator controlled by the sewing machine.

2. Placement device (3) according to claim 1, wherein the decorative elements (5) comprise at least one of rhinestones (5*a*), sequins (5*b*), or rivets and the magazine (7) is at least one of a replaceable or refillable magazine (7).

3. Placement device (3) according to claim 2, wherein at least one of the magazine (7) or a part of the magazine (7), or the decorative elements (5) stored in the magazines (7) can be moved by a feeding device (35) relative to the placement head (9), such that individual ones of the decorative elements (5) can be transferred by the placement head (9) from the magazine (7) to the sheet material (39).

4. Placement device (3) according to claim 3, wherein the magazines (7) are constructed as carrier tapes (7*a*) or as cartridges (7*b*).

5. Placement device (3) according to claim 3, wherein the feeding device (35) is movable by a drive of the sewing machine.

6. Placement device (3) according to claim 1, wherein a sewing foot shaft (13) for attaching the placement device (3) onto a sewing foot presser bar (1) of the sewing machine is constructed on a base part (11), and the placement head (9) or a part thereof is held on the base part (11) so that they can be moved by a drive of a needle bar (23) of the sewing machine.

7. Placement device (3) according to claim 6, further comprising an active or passive element for fixing the decorative elements (5) on the sheet materials (39).

8. Method for placing decorative elements (5) on a textile or non-textile sheet material (39) using a placement device (3) according to claim 1, comprising connecting the placement device (3) to the sewing machine, moving the sheet material (39) in a set position relative to the placement device (3) by hand or automatically using a positioning device, moving a decorative element (5) stored in the magazine (7) into a transfer position relative to the placement head (9), and feeding the decorative element with the placement head (9) which is moved using the drive of the sewing machine or by an external motor or actuator controlled by the sewing machine from the storage position in the magazine (7) to a set position on the sheet material (39), and triggering the setting process by hand or automatically by a control of the sewing machine.

9. Method according to claim 8, further comprising temporarily or permanently connecting the decorative element (5) to the sheet material (39) after the setting.

* * * * *